US005079849A

United States Patent [19]

Nirenberg

[11] Patent Number: 5,079,849

[45] Date of Patent: Jan. 14, 1992

[54] BUTTON AND BUTTONHOLE MARKING MACHINE

[76] Inventor: Morris Nirenberg, 460 Golf Ct., N. Woodmere, N.Y. 11581

[21] Appl. No.: 578,827

[22] Filed: Sep. 6, 1990

[51] Int. Cl.[5] ..... A41H 25/00

[52] U.S. Cl. ..... 33/575; 33/662; 33/576

[58] Field of Search ..... 33/575-579, 33/574, 662, 666, 669, 679

[56] References Cited

U.S. PATENT DOCUMENTS

| | | | |
|---|---|---|---|
| 737,102 | 8/1903 | Holt | 33/666 |
| 1,019,139 | 3/1912 | Eberley | 33/576 |
| 1,057,456 | 4/1913 | Rogers | 33/662 |
| 1,624,622 | 4/1927 | Pectal et al. | 33/575 |
| 1,630,659 | 5/1927 | Hacker | 33/577 |
| 1,969,221 | 8/1934 | Johnson | 33/577 |
| 2,572,682 | 7/1950 | Urish . | |
| 3,331,135 | 7/1965 | Urish | 33/576 |
| 3,442,022 | 5/1969 | Maier | 33/576 |

FOREIGN PATENT DOCUMENTS

| | | | |
|---|---|---|---|
| 799439 | 8/1958 | United Kingdom | 33/662 |

*Primary Examiner*—William A. Cuchlinski, Jr.
*Assistant Examiner*—C. W. Fulton
*Attorney, Agent, or Firm*—Amster, Rothstein & Ebenstein

[57] ABSTRACT

A machine for marking a garment for placement of subsequent operations, such as buttons and buttonholes, includes a frame, a first garment marking plate mounted on the frame and carrying a plurality of first garment marking media, and a second garment marking plate mounted on said frame and carrying a plurality of second garment marking media. Drive means arcuately move the first marking plate relative to the second marking plate between a ready position wherein the first and second marking media are spaced from each other and from the garment and a marking position wherein said first and second marking means are in close proximity to each other and in simultaneous contact with the garment to mark the garment.

34 Claims, 7 Drawing Sheets

BUTTON AND BUTTONHOLE MARKING MACHINE

BACKGROUND OF THE INVENTION

The present invention relates to machines for marking garments for subsequent operations, such as button attachment and buttonhole formation, and, more particularly, to such a machine which marks the garment for buttons and buttonholes simultaneously and speedily in one operation.

It will be understood that while the disclosure of the present invention is in terms of marking machines for garments, and particularly for marking the locations of buttons and buttonholes on garments, the principles of the present invention are equally applicable to the marking of garments for other features, such as pockets, whether using all or only some of the markers. The term "garments" is used expansively herein and includes articles which are not intended for wear on humans, such as wall drapes, furniture covers, parachutes, and any other articles where marking thereon may be desired to indicate the location of future operations thereon.

In the production of garments, there is a frequent need for marking where buttons, buttonholes, pockets, etc., will subsequently be located. The marks are typically made by various media (e.g., chalks, crayons, and inks) which are fluorescent, so that they are not easily visible except when viewed under black (ultraviolet) light, or are easily evaporated, so that they disappear when the garment is hot pressed, or have a limited visible life, so that they disappear shortly after application.

When marking for buttons and buttonholes, it is advantageous to simultaneously mark both by holding the garment edges aligned and in juxtaposition. Simultaneous marking is especially desirable for "stretch" knitted fabrics in order to maintain an accurate registry of the buttons and the buttonholes.

Indicative of the state of the art with respect to machines for making such markings are U.S. Pat. Nos. 2,572,682 and 3,331,135. Essentially, these machines include a fixed frame on which are mounted an assembly of upper markers and an assembly of lower transfer markers, the upper marker assembly being positioned on vertical guide rods to enable strictly linear translational motion of the upper marker assembly upwardly and downwardly. The upper marker assembly moves downwardly into contact with the garment in response to actuation of a foot treadle by the operator. Springs are typically provided on the guide rods in order to return the upper marker assembly to its raised home position after marking of a garment. The garment is supported during marking between the upper and lower marker assemblies on a platen, the platen being slotted so that the lower transfer markers extend therethrough. The upper marker assembly holds marking media (e.g., crayons) which are revolved during marking alternately clockwise and counterclockwise through angles of about 120°-180. The alternate action prevents the bunching of the fabric that would occur with continued rotation in one direction. (It is necessary for the media to have rubbing action against the fabric in order to mark it quickly and clearly.) The upper markers are spring loaded so that uneven wear of the marking media is compensated for by extra travel of the upper marker assembly and the retraction of those markers that have less wear. The lower transfer markers do not contain any marking media, but are merely small textured plugs that undergo the same oscillatory rotary motion as the upper markers, but do not retract. Although both the upper and lower markers have oscillatory rotary motion, at any instant they rotate in opposite directions so as to further cancel any bunching effects on the garment.

In use, the operator first loads the lower transfer markers with marking media from the upper markers by actuating a foot treadle without a garment in place, the foot treadle causing the marking media of the upper marker assembly to contact the textured tops of the lower transfer markers. The operator then releases the treadle, inserts the garment in position on the platen between the assemblies, and depresses the foot treadle again to cause the upper markers to contact the garment and press it against the now media-loaded lower transfer markers. Thus, each garment requires two separate foot treadle actions on the part of the operator, with the concomitant loss of productivity and increase in operator fatigue. It will be appreciated that the operator controls the time duration of contact between the markers and the garment, this time desirably being based upon garment material, texture, color and the like, and therefore varying with each individual job.

The present marking machines have not proven to be entirely satisfactory in use. Because of the strictly vertical translational displacement of the upper marker assembly, the marking machines tend to be bulky and high in order to enable adequate clearance between the upper and lower markers during insertion and removal of garments. Because of the guide rods at each end of the marking machine, the garment must be inserted from the front or rear of the machine (that is, perpendicular to its long axis) and end-loading is precluded, although end-loading would facilitate the marking of long items (such as curtains and draperies), the marking off of rolls of material, and the like. The design of a marking machine along strictly vertical displacement principles further interferes with the full visibility of the garment to the operator because the upper marker assembly may be in his line of vision while the garment is being inserted into the machine.

Because the lower marking plate and the platen are both stationary, with the tops of the lower transfer markers extending upwardly through a slot in the platen, the garment tends to come into contact with the loaded lower transfer markers during the operation of inserting the garment into the marking machine, thereby producing unintended, extraneous and possibly misleading markings on the garment by the lower transfer markers.

The main problems exemplified by the known marking machines relate, however, to their low production rate, short marking media life, and poor quality of the marks produced. Because the marking media (typically crayons) are disposed only on the upper markers, the marking machine must be cycled twice in order to produce the desired set of marks—that is, it must be cycled once without the garment present to cause the marking media from the upper markers to load the lower transfer markers, and a second time with the garment in it to cause marking of the garment directly by the marking media from the upper markers and by the now loaded lower transfer markers. Thus, the machine is in productive use only 50% of the time, with the remainder of the time being spent loading the lower markers with marking media. The short life of the marking media in the marking machine is but another reflection of this problem, with the marking media having to be replaced in the upper markers twice as often as would be the case if the lower markers had an independent media marking supply. Thus, the frequency of loading new crayons or similar marking media in the upper markers is twice as high as would be the case if the upper markers were used only to mark the garment directly.

A further problem with the use of lower transfer markers which must be loaded with the marking media is that the plug portion of the lower transfer marker which receives the marking media from the upper marker and subsequently transfers it to the garment must represent a design "trade-off" between the texture that readily accepts the marking media from the upper marker and one that will readily transfer it to the garment. Accordingly, the marks produced by the upper markers and the lower transfer markers are often less clear than desirable, especially the marks produced by the lower transfer markers.

Use of the foot treadle to close the marking plates twice per garment (once to load the lower markers with marking media, and once to mark the garment) requires substantial operator energy, leading to fatigue and variations in operator performance. The problem is further complicated by the dependence of the marking operation upon the individual marking machine operator, the marking machine operator himself varying over time, and differing from other marking machine operators. The extent to which the foot treadle is depressed, and the force used in doing so, may vary with a resultant variation in the degree of contact between the markers and the garment, the duration of the contact, and the force of the contact.

Accordingly, it is an object of the present invention to provide a marking machine having about twice the production rate and about twice the marking media life of a conventional marking machine.

Another object is to provide such a marking machine which produces high quality marks with a minimum of effort by the operator of the machine and without unduly tiring the operator.

A further object is to provide such a machine which enables end-loading of the garment and a substantially clearer view of the garment to the operator during the insertion operation.

It is also an object of the present invention to provide such a machine which avoids the unintended marking of the garment by the lower markers during the garment insertion and removal operations.

It is another object to provide such a machine which is of economical and rugged construction, easy to maintain and simple to use.

SUMMARY OF THE INVENTION

The above and related objects of the present invention are obtained in a machine for marking a garment for subsequent operations (such as for placement of buttons and buttonholes) which comprises a frame, a first garment marking plate mounted on the frame and carrying a plurality of first garment marking media, and a second garment marking plate mounted on the frame and carrying a plurality of second garment marking media. Drive means move the first marking plate relative to the second marking plate between a ready position wherein the first and second marking media are spaced from each other and from the garment and a marking position wherein the first and second marking media are in close proximity to each other and in simultaneous contact with the garment to mark the garment.

In a preferred embodiment, the drive means includes means for arcuately moving the first marking plate relative to the second marking plate, including means for pivoting the first marking plate about an axis of rotation. The drive means further includes equalizer means for moving the first and second marking media relative to the garment with oppositely-directed angular velocity at the moment of contact with the garment, preferably to approach the garment relatively with equal but oppositely-directed angular velocity at the moment of contact with the garment. The drive means also causes the first and second marking plates to return to the ready position a predetermined period after the first marking plate approaches the marking position, and may include means for varying the predetermined period. The drive means is actuatable for a cycle of movement from the ready position to the marking position and back to the ready position by a smart switch requiring release thereof intermediate repetitions of the cycle. The marking media are spring-loaded on their respective marking plates.

In an especially preferred embodiment, a platen is mounted on the frame intermediate the first and second marking plates for supporting the garment and maintaining it spaced from the first and second marking media when the first and second marking plates are in the ready position. The platen includes openings therein to permit passage of the second marking media therethrough. The equalizer means causes the platen to move arcuately in the same arcuate direction as the first marking plate and referably at about 50% of the velocity of the first marking plate) at the moment of contact with the garment, the first marking plate and the platen both being pivotable about the same axis of rotation. The equalizer means causes the platen to pivot through a fraction (preferably about 50%) of the angle through which the first marking plate is pivoted during the same period. The equalizer means does not cause the platen to pivot during the initial major portion of the movement of the first marking plate, but then initiates movement of the platen when the first marking media are about 0.015 inch from the garment, pivoting the platen about only 1.5 degrees to effect a platen movement of no more than about 0.25 inch.

The frame is configured and dimensioned to enable end-loading of a garment onto the platen intermediate the marking plates.

The present invention also encompasses a machine useful for marking only one side of the garment. This machine comprises a stationary frame, a garment mounting plate mounted on the frame and carrying a plurality of garment marking media, and a stationary Platen mounted on the frame for supporting the garment. Drive means arcuately move the marking plate relative to the platen between a ready position wherein the marking media are spaced from the garment, and a marking position wherein the marking media are in contact with the garment to mark the garment. Preferably the drive means includes means for pivoting the marking plate about an axis of rotation.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
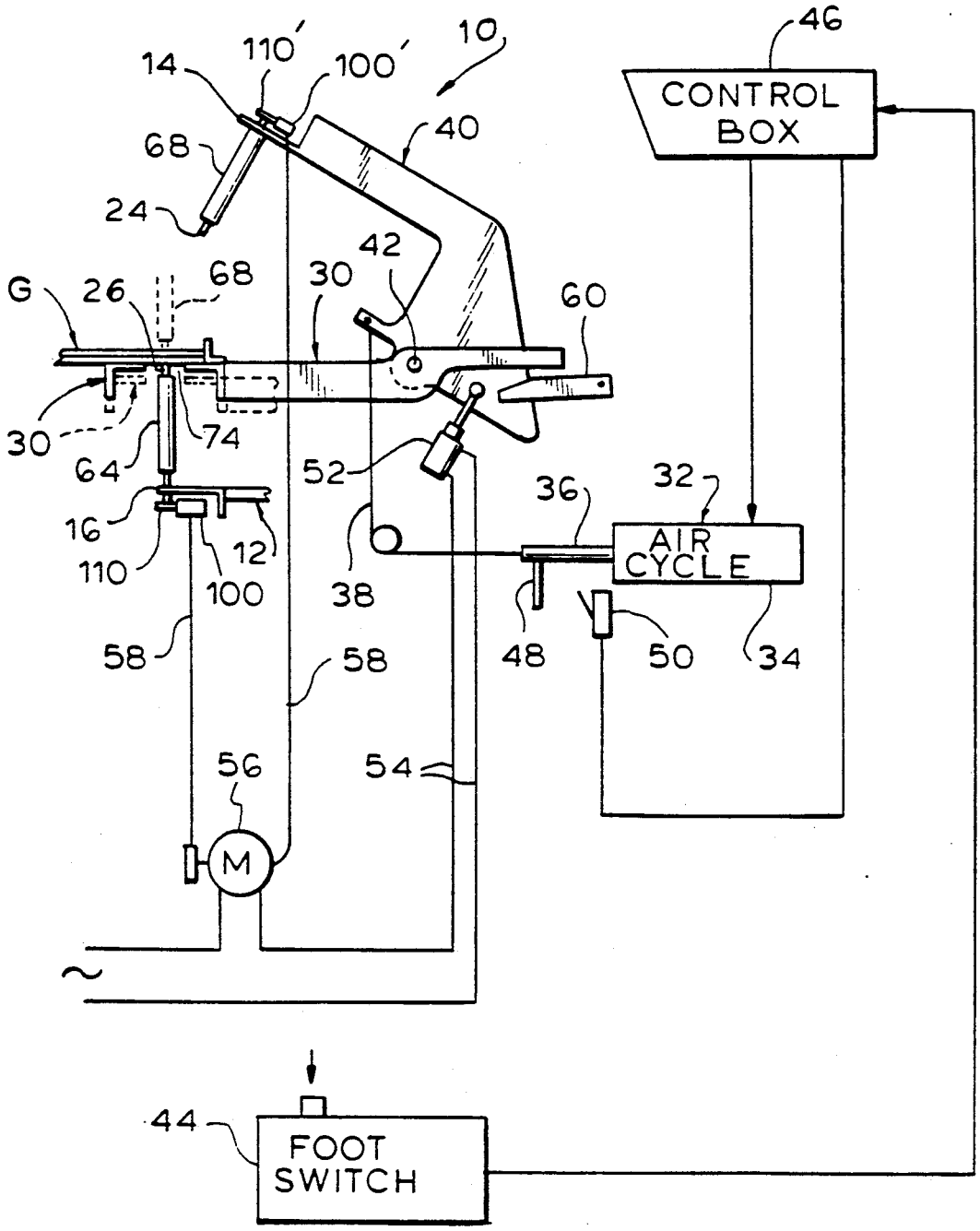
FIG. 1 is a schematic representation of a machine according to the present invention, with the elements thereof being shown in the ready position in solid line and in the marking position in phantom line.

Referring now to the drawing, and in particular to FIG. 1 thereof, therein illustrated schematically is a machine, generally designated by the reference numeral 10, according to the present invention. The machine is used to mark a garment G for placement of subsequent operations such as button attachment and buttonhole formation, for attachment of pockets, and the like. While the machine 10 may be used simply to mark the garment G at a series of paired points (e.g., on opposite sides of a piece of a fabric) for a single operation (e.g., buttons and buttonholes) or at different points for entirely unrelated operations (e.g., for attachment of a spare button and for location of a breast pocket), the machine finds particular utility for marking a garment for placement of pairs of related operations requiring a fixed spatial disposition relative to one another, such as the location of a button and the buttonhole through which it is to go, a pair of side pockets, or the like.

The machine 10 includes a frame generally designated 12 (see FIGS. 2-7), and first and second garment marking plates 14, 16 mounted on the frame 12. Typically, the marking plates 14, 16 are mounted on the frame 12 with the first marking plate 14 being an upper plate normally tilted upwardly and forwardly and the second marking plate 16 being a generally horizontal lower plate. In a preferred embodiment of the machine 10, the first or upper marking plate 14 is pivotally mounted on the frame 12, while the second or lower marking plate 16 is fixedly mounted on the frame 12. The upper marking plate 14 carries a plurality of upper garment marking media 24, while the lower marking plate 16 carries a plurality of lower garment marking media 26. A platen 30 is pivotally mounted on the main central shaft 42 of the frame 12, with its front end intermediate the upper and lower marking plates 14, 16 for supporting the garment G and maintaining it spaced from both the upper and lower marking media 24, 26 during insertion and removal of the garment from the machine 10.

Drive means, generally designated 32, are provided for moving the first marking plate 14 relative to the second marking plate 16 between a ready position, wherein the first and second marking media 24, 26 are spaced from each other and from the garment G, and a marking position, wherein the first and second marking media 24, 26 are in close proximity to one another and in simultaneous contact with the garment G to mark the garment for the placement of subsequent of operations. The drive means 32 includes a pneumatic cylinder 34 having a piston 36 which, upon retraction, pulls one end of a flexible wire 38. A pivot arm generally designated 40 is pivotally mounted on central main shaft 42 of the frame 12, bears the upper marking plate 14 at its forward end, and is connected to the other end of flexible wire 38 at its rear end. The pull of piston 36 on flexible wire 38 causes the pivot arm 40 to pivot about shaft 42 in such a manner as to cause the upper marking plate 14 (and hence the upper marking media 24) to approach the garment G on platen 30 and the lower marking plate 16 (and hence the lower marking media (26). The air cylinder 34 of drive means 32 is actuated by a foot or knee switch or trigger 44, actuatable by the operator of the marking machine 10, which acts through a control box 46 to pneumatically induce piston 36 to withdraw into pneumatic cylinder 34 and hence lower the upper marking plate 14 by pulling on flexible wire 38. As the piston 36 retreats into the pneumatic cylinder 34, a depending shoulder 48 thereof contacts a "kill" switch which causes the control box 46 to deactivate pneumatic cylinder 34 after a variable predetermined time. At this point, the spring loaded pivot arm 40 bearing the upper marking plate 14 is withdrawn to its original position. However, prior to deactuation of pneumatic cylinder 34, the movement of piston arm 40 has various effects which occur during the time delay.

Figure 8:
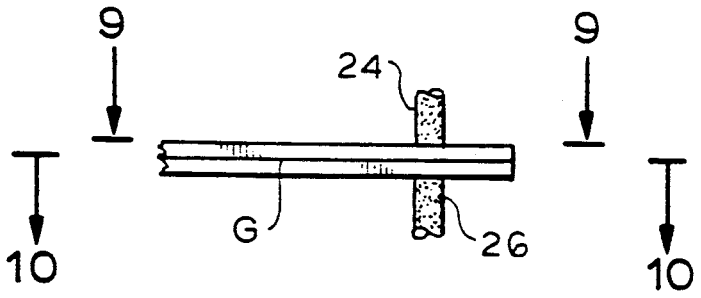
FIG. 8 is a fragmentary side elevational view, to a greatly enlarged scale, of a garment at the moment of contact by the marking media.
Figure 9:
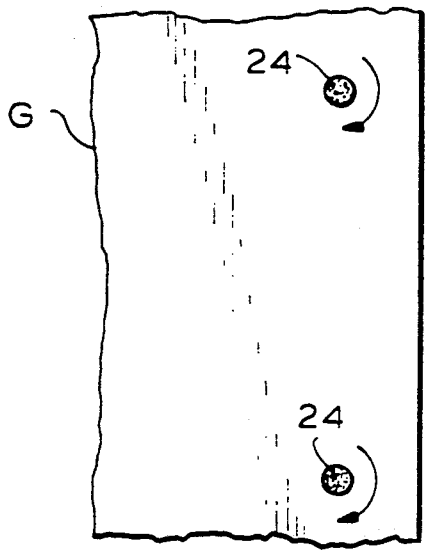
FIG. 9 is a fragmentary sectional view thereof taken along the line 9—9 of FIG. 8 and showing the motion of the upper marking media.
Figure 10:
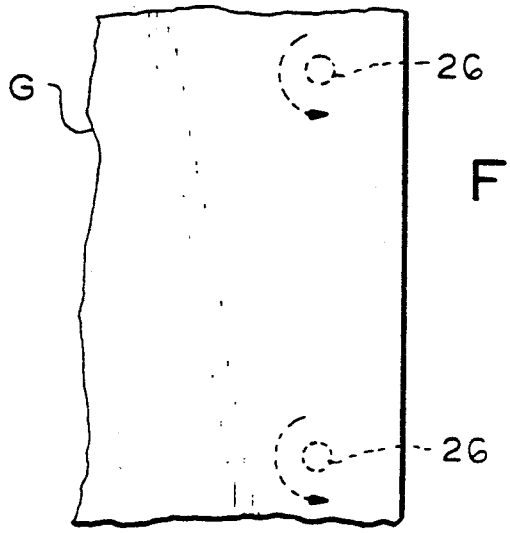
FIG. 10 is a fragmentary sectional view thereof taken along the line 10—10 of FIG. 8 and showing the motion of the lower marking media.

First, the pivoting of the pivot arm 40 energizes a normally open switch 52 and thereby closes a circuit 54 and energizes a motor 56. The motor 56, acting through various linkages 58 with the upper marking media 24 and the lower marking media 26, causes these marking media 24, 26 to rotate back and forth in opposite directions (one proceeding clockwise while the other proceeds counterclockwise, and vice versa), so that, as best seen in FIGS. 8-10, the marking media 24, 26 are rotating while they are in contact with the garment G. Such rotation of the marking media 24, 26 while they are in contact with the garment G is necessary if a good, clear mark is to be produced within a reasonable period of time. The marking media 24, 26 rotate in opposite directions in order to prevent bunching of the garment G under their influence. As the pivot arm 40 is withdrawn to its original position by its spring (not shown in FIG. 1), it permits switch 52 to return to its normally open setting, thereby breaking the circuit 54 and deactuating the motor 56. While this arrangement avoids unnecessary rotation of the marking media 24, 26 (that is, rotation thereof while they are not in contact with the garment G), alternatively switch 52 may be manually controlled to keep circuit 54 closed and motor 56 actuated, and hence the marking 24, 26 in rotation, during normal usage of the machine 10, regardless of whether or not the marking media 24, 26 are at any given instant in contact with the garment G.

Second, as the pivot arm 40 closely approaches the garment G, it actuates a mechanism 60 which causes the forward end of the platen 30 (and hence the garment G supported thereon) to pivot downwardly and approach the lower marking media 26. This is illustrated in FIG. 1 by the downward movement of the upper marking media 24 from its solid line position to its phantom line position and by the downward movement of the platen 30 from its solid line position to its phantom line position If, as preferred, the upper marking media 24 approaches the lower marking media 26 with an angular velocity V and the platen 30 descends towards the lower marking media 26 with an angular velocity of 0.5V, then both marking media 24, 26 are, at the point of contact with the garment G, approaching the same with oppositely directed but equal angular velocity. This insures that good, clear markings are produced on the garment G by the marking media 24, 26 in a rapid and reproducible manner, as the marking media 24, 26 are rotated in response to actuation of the motor 56. As is illustrated in FIGS. 2–4, the platen 30 and pivot arm 40 preferably share a common axis of rotation—namely, main shaft 42.

The mechanism 60 for causing the platen 30 (and the garment G thereon) to be approached by marking media 24, 26 from opposite non-linear or arcuate angular directions, and preferably at equal velocities, is referred to as an "equalizer." As the equalizer 60 causes both sets of marking media 24, 26 to approach the garment G with equal but opposite velocity, the wear on the marking media sets 24, 26 is equal, thus minimizing downtime of the machine 10 for marking media replacement. While the function of the equalizer 60 could be performed by a control function of the control box 46 acting electrically to lower the platen 30, it is cheaper, more efficient, and more easily adjustable if the equalizer 60 constitutes a mechanical linkage between the upper pivot arm 40 (and hence the upper marking plate 14) and the platen 30, as illustrated in FIGS. 2–4. The platen 30 is biased by a spring not shown in FIG. 1) for automatic return to its original position once it is released by the equalizer 60.

It will be appreciated that in an alternative construction, the platen 30 may be stationary and the lower marking plate 16 (shown as stationary) may be mounted for pivotal movement, preferably about the same axis of rotation 42 as the pivot arm 40. Thus, instead of the platen 30 pivoting downwardly, the lower marking plate 16 may be caused to pivot upwardly from a depressed position, again, to insure that the garment 30 is approached by the marking media 24, 26 from different sides, with oppositely directed angular velocities, which are preferably equal in magnitude.

Figure 2:
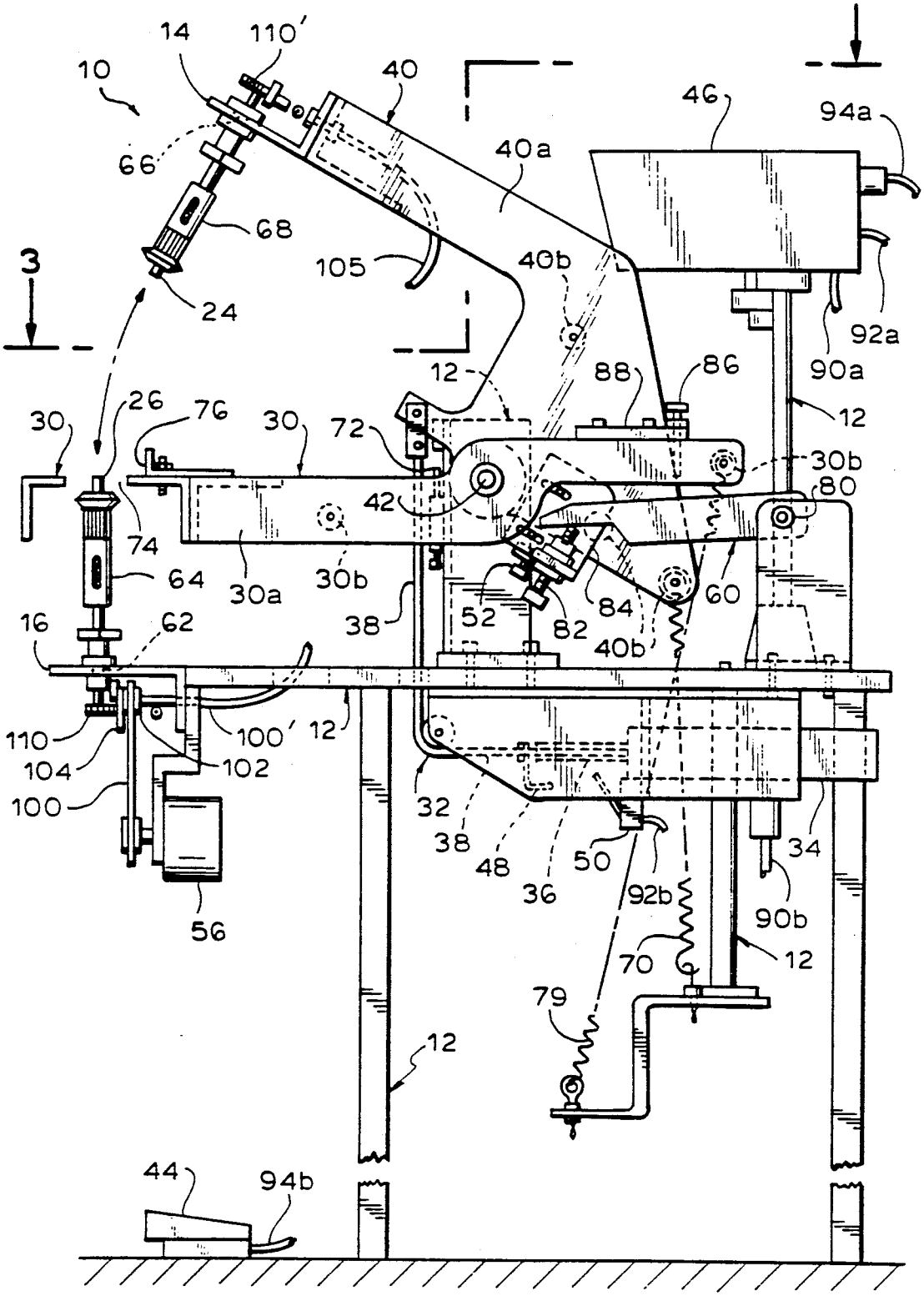
FIG. 2 is a fragmentary side elevational view thereof, with the machine elements in the ready position.
Figure 3:
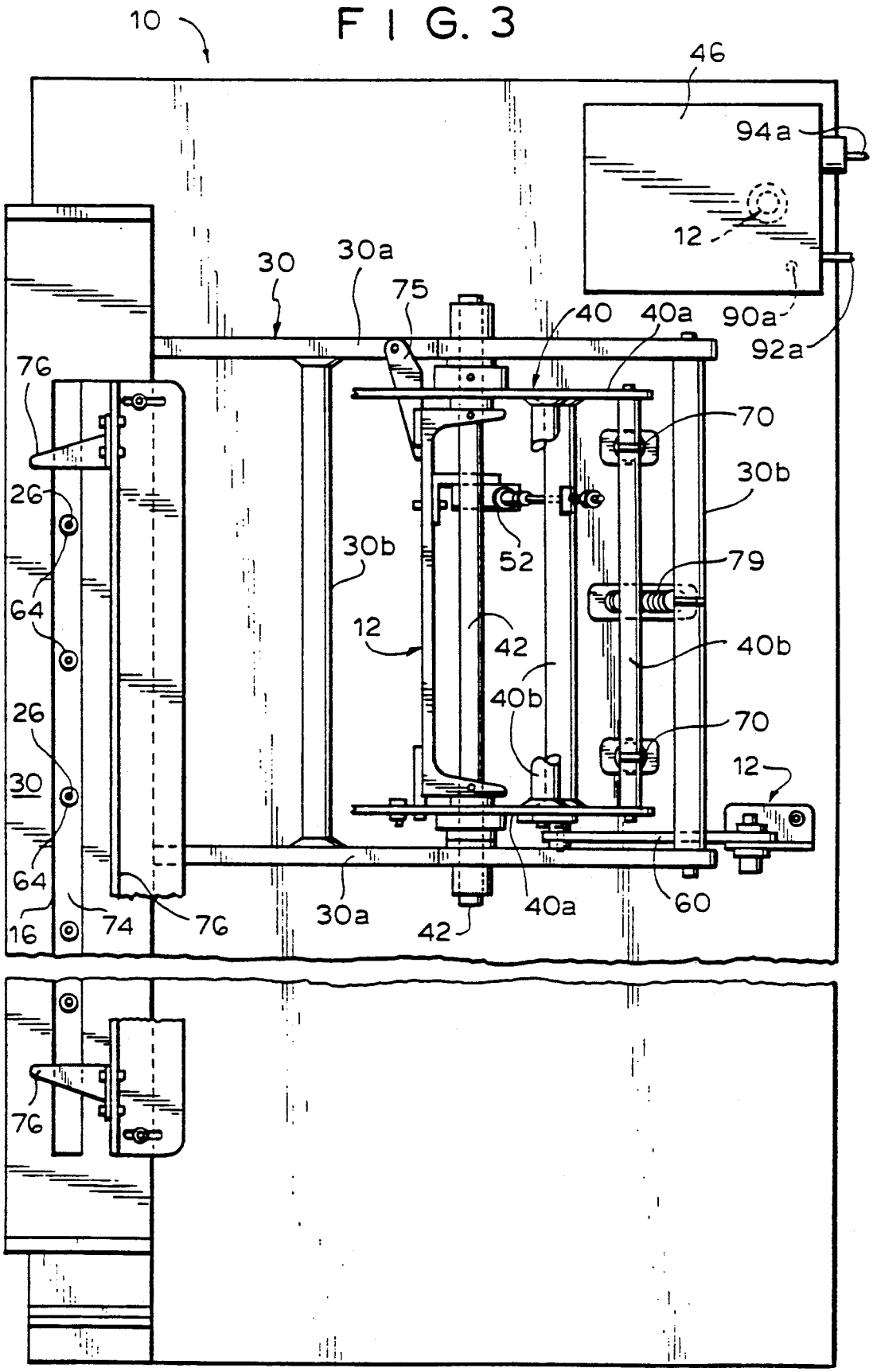
FIG. 3 is a fragmentary top plan view thereof taken along the line 3—3 of FIG. 2.
Figure 4:
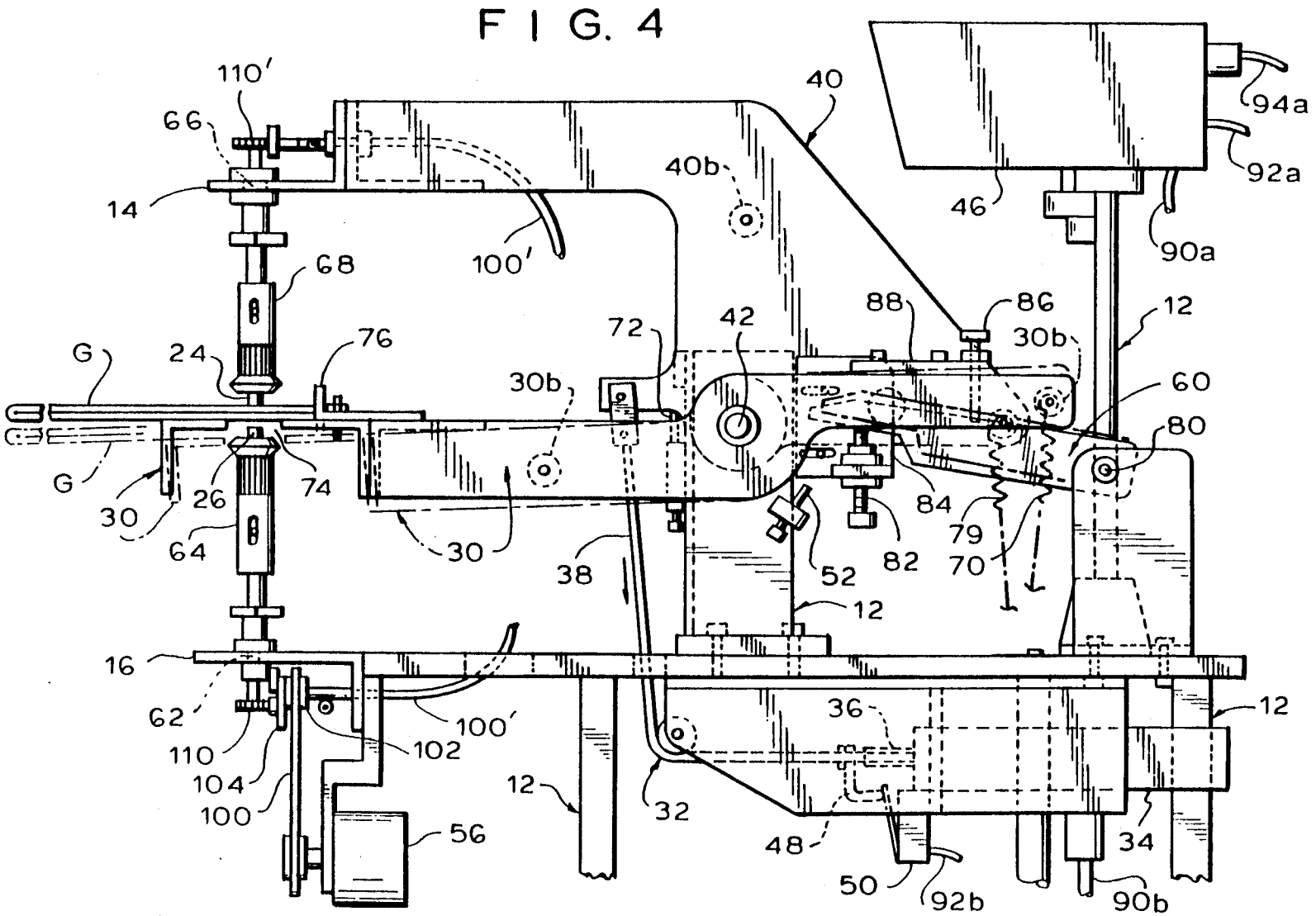
FIG. 4 is a side elevational view thereof with the platen and equalizer in an intermediate position in solid line and in the marking position in phantom line.

Turning now more particularly to the structure of the machine 10, and referring in particular to FIGS. 2 and 3, the frame 12 supports a lower marker plate 16 which preferably extends generally horizontally in a fixed orientation. The lower marking plate 16 defines a slot 62 in which are rotatably mounted a plurality of lower marker chucks 64. The marker chucks 64, when loose, may be slid laterally along marking plate slot 62 into desired positions, and then tightened to fix them to the lower marking plate 16 in the selected positions. The marker chucks 64 extend generally upwards, and each is adapted to, receive and carry a spring-loaded lower marking medium 26 protruding from the top thereof.

Similarly, the frame 12 supports a pivot arm 40 comprising two horizontally spaced vertical plates **40*a* connected by spacer rods 40*b*. However the pivot arm 40 is pivotally mounted on the frame 12 for rotation about main shaft 42 and is normally oriented in a generally upwardly and forwardly tilt in the ready position of FIG. 2. The forward end (to the left as shown in FIG. 2) of the pivot arm 40 carries an upper marking plate 14. The upper marking plate 14 defines a channel or slot 66 in which are rotatably mounted a plurality of upper marker chucks 68, the upper marker chucks 68 being adjustably positioned laterally in slot 66 just as the lower marker chucks 64 are adjustably positioned in slot 62. The marker chucks 68 extend generally downwards, and each is adapted to receive and carry a spring-loaded upper marking medium 24** protruding from the bottom thereof. As the adjustable positioning and fixing of a marker chuck relative to a marking plate and the spring-loading of a marking medium, such as a crayon, within a marker chuck is well known in the marking machine art in connection with upper marking plates, further details thereof are not deemed necessary herein.

Similarly, the frame 12 supports a platen 30 comprising a horizontally spaced pair of vertical plates **30*a* connected by spacer rods 30*b*. Platen 30 is pivotably mounted on frame 12 for rotation about main shaft 42, like the pivot arm 40, but is normally oriented in a generally horizontal orientation in the ready position of FIG. 2. The front end of platen 30 defines a slot 74 which is vertically aligned with the lower marking media 26 such that, upon suitable downward arcuate pivoting of the front end of platen 30 about its axis of rotation 42, the lower marking media 26 pass through the slot 74 and contact the garment G disposed on the forward end of platen 30 (see FIG. 4). A variety of different guides 76 are preferably secured to the platen 30 to insure that the garment G is appropriately positioned thereon for marking. The guides 76 are preferably adjustable in location on the platen 30** so that they can be best situated for appropriate positioning of the garment on the platen. Such adjustable guides are well known in the marking machine art.

The pivot arm 40, as earlier noted, is pivotally mounted on a shaft 42. A spring 70, connected at one end to the frame 12 and at the other end to the rear of pivot arm 40, biases the pivot arm 40 to a ready position wherein the front of the pivot arm 40, which carries the upper marking medium 24, is elevated sufficiently to easily enable the garment G to be placed and arranged on the platen 30 without obstructing the vision of the operator from the front of the marking machine. The movement of the pivot arm 40 in response to the pull of spring 70 is limited by the pneumatic cylinder 34 to which the pivot arm 40 is connected by flexible wire 38. Motion of the pivot arm 40 which brings the marking media 24 into the marking position adjacent garment G is effected by the pneumatic cylinder 34 acting through piston 36 and flexible wire 38. An adjustable stop 72 fixed to frame 12 is adjusted to limit the movement of the pivot arm from the ready position to the marking position—that is, to limit the downward travel of the upper marking media 24.

The platen 30 is biased to its normally generally horizontal or ready orientation by an elongate tension spring 79 connecting the frame 12 and the rear of the platen 30 so as to cause downward pivoting of the rear of platen 30 and upward pivoting of the front of platen 30. An adjustable stop 75 fixed to frame 12 limits this motion of the platen 30 to a generally horizontal orientation against the bias of spring 79. Spring 79 is of sufficient strength that, unless forcibly displaced by the equalizer 60 as described hereinafter, platen 30 maintains a generally horizontal orientation.

Equalizer 60 is a lever pivotally mounted at the rear (see point 80) to the frame 12. The equalizer 60 is not biased (except by gravity) to pivot in either direction, but rather is free to move within a limited arc determined by the pivotable platen 30 and the pivotable pivot arm 40. An adjustable lower equalizer stop 82 is mounted on the back of pivot arm 40 by means of an adjustable bracket 84, and an adjustable upper equalizer stop 86 is mounted on the rear of platen 30 by an adjustable bracket 88. As the pivot arm 40 pulls the upper marking media 24 from the ready position to the marking position, the adjustable stop 82 carried thereby is lifted with the rear of the pivot arm 40 and hence lifts the front end of the equalizer 60 (which at all times rests thereon due to gravity). Eventually, after a limited free motion, the equalizer 60 contacts the adjustable stop 86 on the rear of platen 30 (see the intermediate position of FIG. 4 in solid line) and thereafter lifts the rear of platen 30, thereby lowering the front of platen 30 so that the garment G carried over the platen slot 74 is contacted by the lower marking media 26 (see the marking position of FIG. 4 in phantom line). The adjustable nature of the stops 82, 86 and the brackets 84, 88 upon which they are mounted enable both fine and gross adjustment of the manner in which the velocity and displacement of pivot arm 40 is translated into the velocity and displacement of platen 30. It will be appreciated that, while a substantial motion of the upper marking plate 14 is desired (so as to facilitate insertion and removal of the garment and viewing by the operator during the insertion process), only a very limited motion of the platen 30 is required. Typically the adjustable stops 82, 86 are adjusted so that the platen does not pivot at all during the initial major portion of the movement of the pivot arm 40, with the stops initiating platen movement only when the upper marking media 24 are about 0.015 inch from the garment G and then pivoting the platen about only 1.5° or no more than about 0.25 inch downwardly. The platen and equalizer displacements are greatly exaggerated in FIGS. 1 and 4 for expository purposes.

The control box 46 is responsive to the actuation of trigger 44 by any convenient means such as the hand, knee, or foot of the operator, the trigger 44 being shown as positioned for foot actuation. As the trigger 44 is not a treadle which physically moves the pivot arm, but merely an electrical switch, operation thereof is not fatiguing to the operator. In any case, the trigger 44 need be actuated only once per cycle. The trigger 44 is a "smart" switch of the type well known in the switching art, which requires that the pressure actuating the same be temporarily released before the trigger 44 can be reactivated. Thus continued pressure on the trigger 44 initiates only one cycle—i.e., one actuation of the air cylinder 34 to cause retreat of piston 36 and movement of pivot arm 40 to the marking position.

The control box also includes a variable time delay which is actuated by kill switch 50 and delays release of the pressure in air cylinder 34, which release results in pivot arm 40 being returned to the ready position by spring 70. (If desired, spring 70 may be omitted and movement of pivot arm 40 to both the ready position and the marking position controlled instead by control box 46 acting through pneumatic cylinder 34.) The control box 46 includes a rotary switch or potentiometer (not shown) or the like for adjusting the time delay—for example, from about 0.1 to about 5 seconds. As the time delay fixes the period of contact between the upper and lower marking media 24, 26 and the garment G, it can be set for the particular type of work and materials involved so as to obtain uniformity and independence from operator variation. This results in more repeatable and controlled marking of the garment as control is not vested in the operator. Further, as the settings of the adjustable stops 82, 86 control the contact speed and contact pressure, virtual independence of operator control is achieved so as to further ensure more reliable and uniform marking of the garments. Contact pressure is primarily affected by the spring loading of the marking media 24, 26 in their respective marker chucks.

More particularly, the electrical output 90*a* of control box 46 is connected to the electrical inlet 90*b* of a solenoid valve (not shown) in the pneumatic cylinder 34 for control of the positioning of piston 36 therein, while the electrical inputs 92*a* and 94*a* of control box 46 are in electrical connection with and controlled by the electrical output 92*b* of kill switch 50 and the electrical output 94*b* of trigger 44, respectively.

As already noted, the marking media 24, 26 must be rotated upon contact with the garment G in order to leave clear marks thereon within a reasonable period of time. Accordingly, as the pivot arm 40 is moved from the ready position to the marking position, it actuates a normally open switch 52, thereby closing electrical circuit 54 and energizing motor 56. Upon energization, motor 56, acting through various means linkages, causes the marker chucks 68, 64 within the slots 66, 62 of the upper and lower marking plates 14, 16, and thus the upper and lower marking media 24, 26 projecting therefrom, to rotate in the desired pattern. Typically, the marking media 24, 26 are rotated 120°–180° alternately in opposite directions, with each upper marking media being rotated in the opposite direction from its respective lower marking media at all times.

Figure 5:
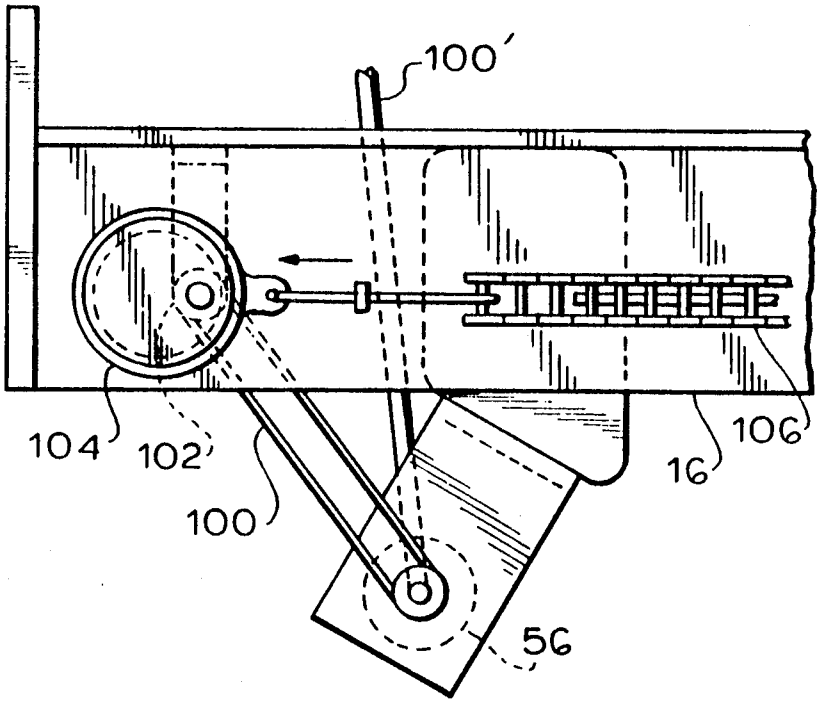
FIG. 5 is a fragmentary side elevational view, to a greatly enlarged scale, of the lower drive assembly for rotating the lower marking media.
Figure 6:
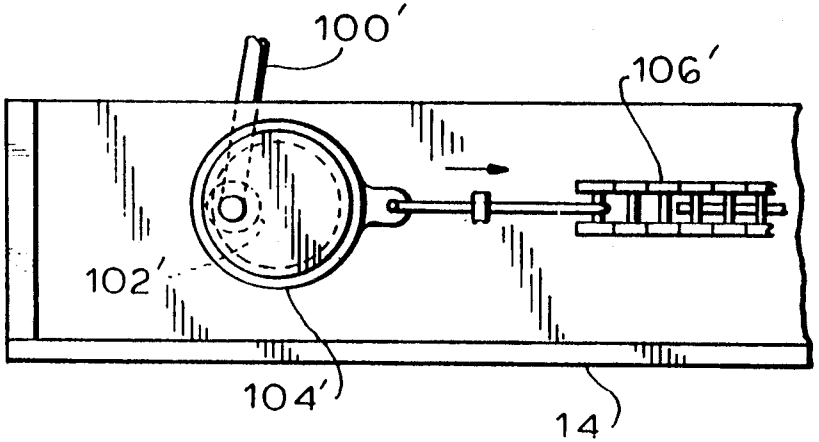
FIG. 6 is a fragmentary side elevational view, to a greatly enlarged scale, of the upper drive assembly for rotating the upper marking media.
Figure 7:
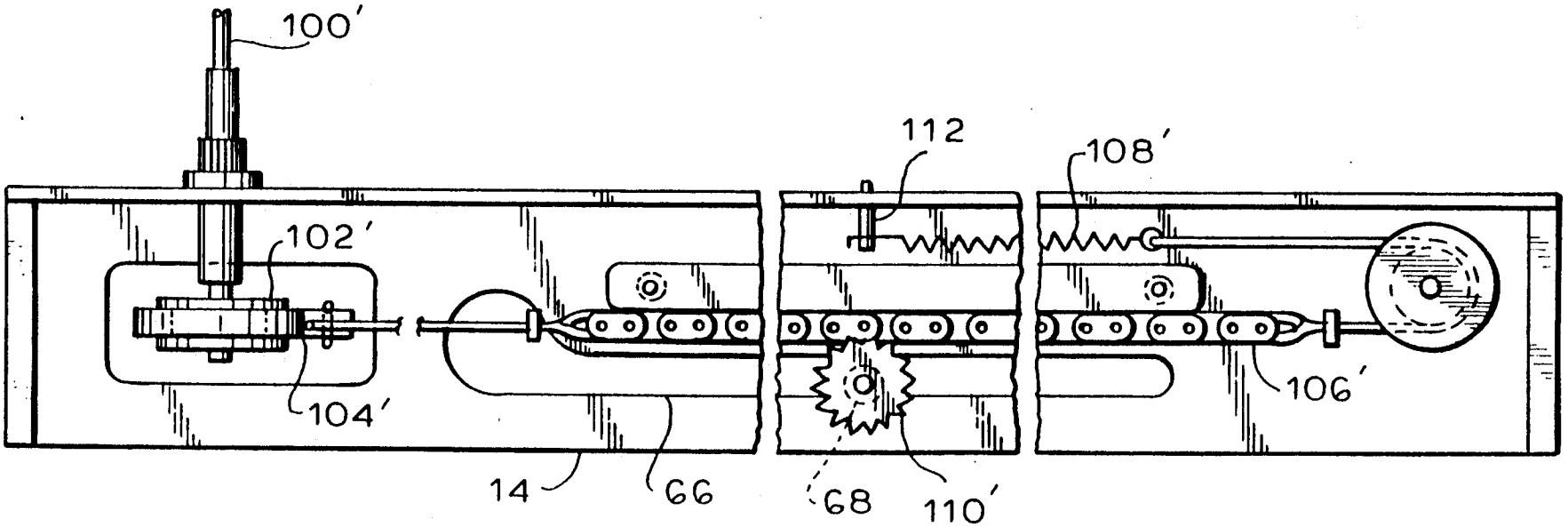
FIG. 7 is a fragmentary side elevational view, to a greatly enlarged scale, of the drive system for rotating the upper marking media.

Referring now to FIGS. 5 and 7 in particular, rotation of the motor 56 (see FIG. 5) drives a timing belt 100, which in turn drives an eccentric 102 of the lower drive assembly. The rotation of eccentric 102 in turns drives a resilient converter 104, which converts the rotational motion of the eccentric 102 into the desired linear motion of a chain 106 secured at one end to the converter 104 and at the other end to the frame 12 by a spring (not shown). More particularly, the rotary motion of the eccentric 102 is converted by converter 104 into an oscillating translational motion of the chain 106, the chain 106 being biased in one direction by the spring and pulled in the opposite direction by the movement of the eccentric 102. The oscillating translational motion of chain 106 causes oscillation of the gear 110, which in turn causes the desired oscillating pivoting action of lower marker chuck 64 and marking media 26. The mechanism for causing rotation of the upper marking media 24, as illustrated FIGS. 6–7, is similar to the bell crank mechanism for causing rotation of the lower marking media 26, as illustrated in FIG. 5, except that the rotation of motor 56 is conveyed through a flexible drive 100' (see FIG. 5 also) to effect rotary motion of an eccentric 102' which in turn acts through a converter 104' to cause oscillating translational motion of a chain 106′ connected to a relatively fixed anchor 112 by a spring 108′. The oscillating translational motion of the chain 106′ causes oscillating rotation of gear 110′ and a corresponding movement of the upper marker chuck 68 and marking media 24. As rotation of upper marker chucks and the marking media carried thereby is well known in the art, further details thereof are not deemed necessary herein.

Prior to operation of machine 10, the delay period is set manually in control box 46, and the adjustable stops 86, 82 (and the adjustable brackets 84, 88) and the adjustable stopper 72 for the pivot arm 40 are set, in light of the particular thickness of the garment G to be marked, to ensure that the marking media 24, 26 at the time of contact with the garment G are moving with opposite and preferably equal angular velocities relative to the garment G carried by platen 30.

To operate the machine 10, the operator simply inserts the garment G on the front end of platen 30 with the button and buttonhole areas in appropriate vertical alignment with each other and the garment G appropriately positioned according to the guides 76. Once the garment G is appropriately positioned, the operator actuates the trigger 44 with his foot, knee or other portion of the body. Upon actuation of trigger 44, the control box 46 actuates pneumatic cylinder 34 (through control box outlet 90*a* and pneumatic cylinder inlet 90*b*) to cause retreat of piston 36 within pneumatic cylinder 34. Retreat of the piston 36 into pneumatic cylinder 34 acts through flexible wire 38 to cause pivot arm 40 to rotate about main shaft 42 from the upwardly tilted ready orientation towards the generally horizontal marking orientation until it contacts adjustable stop 72. The shoulder 48 of piston 36 actuates kill switch 50 so that, after a predetermined time interval (as determined by the setting of the delay in control box 46), the pneumatic cylinder 34 is deactivated. The pivoting of the pivot arm 40 also closes normally open switch 52 and thereby actuates motor 56 through circuit 54, thus causing the desired oscillating motion of the upper and lower marker chucks 68, 64 and the marking media 24, 26 carried thereby. As the pivot arm 40 continues its movement towards the marking position, the adjustable stop 82 carried thereby raises the front end of equalizer 60 until that front end contacts adjustable stop 86 carried by platen 30 and thereby causes rotation of platen 30 about main shaft 42 from the generally horizontal ready orientation to the slightly tilted marking orientation until it contacts adjustable stop 75 (and more particularly the lifting of the platen rear end and the lowering of the platen front end). As the platen front end descends, the lower marking media 26 enters the platen slot 74 and contacts the garment G at the same time as the upper marking media 24 borne by pivot arm 40 contact the garment G, preferably with both sets of marking media 24, 26 travelling in opposite angular velocities of equal magnitude relative to the platen. The marking media 24, 26 remain in contact with the garment G, continuing their rotation about their longitudinal axes, until the end of the delay preset in the control box 46, at which time the pressure in pneumatic cylinder 34 is released so that spring 70 can return to pivot arm 40 to its normal ready position and spring 79 can return platen 30 to its normal ready orientation.

To summarize, the present invention provides a marking machine having about twice the conventional production rate and about twice the marking media life of a conventional marking machine. It produces high quality marks with a minimum of effort by the operator of the machine without unduly tiring the operator, while affording a substantially clearer view of the garment during the insertion step and the possibility of end-loading the garment. Unintended marking of the garment by the lower markers during the garment insertion and removal operations is avoided. Finally, the machine is of an economical and rugged construction, easy to maintain and simple to use.

It will be appreciated that the machine described above is useful not only where pairs of vertically aligned marks are to be made from opposite sides on the garment by upper and lower marking media (such as for marking buttons and buttonholes), but also where marks are to be placed only on one side of a garment (for example, to mark the location of pockets, spare buttons, or the like). In such an instance, it is only necessary for the upper marking media 24 to be driven to make the necessary marks. Accordingly, the adjustable brackets 84, 88 and the adjustable stops 82, 86 carried thereon are adjusted so that travel of the pivot arm 40 from the ready position to the marking position is effectuated without the equalizer causing displacement of the platen 30. Indeed, if desired, platen 30 may also be fixed in position by means of a stop or lock (not shown). Further, the slot 74 in platen 30 may be covered by a thin metal plate to provide extra support for the garment placed thereon and ensure that no contact occurs between the garment and the lower marking media 26 (which may be left in place). In the machine so modified, the upper marking plate 14 remains pivotable, the platen 30 becomes stationary, and the function (and optionally the structure) of the lower marking plate 16 is dispensed with, the drive simply moving the upper marking media into and out of contact with the garment. The machine still afford many of the advantages noted above with respect to machines for marking pairs of vertically aligned marks on garments, such as possible end-loading of the garment onto the platen, clear viewing of the garment during the insertion process, a lower profile for the machine as a whole (all due to the arcuate—as opposed to linear—movement of the upper marking plate), virtual independence of operator control (due to use of the trigger 44 and control box 46), and the like.

Now that the preferred embodiments of the present invention have been shown and described in detail, various modifications and improvements thereon will become readily apparent to those skilled in the art. Accordingly, the present invention is to be construed broadly and in a manner consistent with the spirit and scope of the invention claimed herein.

I claim:

1. A machine for marking a garment for subsequent operations, comprising:

(A) a frame;

(B) a first garment marking plate mounted on said frame and carrying a plurality of first garment marking media;

(C) a second garment marking plate mounted on said frame and carrying a plurality of second garment marking media; and (D) drive means for moving said first marking plate relative to said second marking plate between a ready position wherein said first and second marking media are spaced from each other and from the garment and a marking position wherein said first and second marking media are in close proximity to each other and simultaneously initiate contact with the garment to mark the garment.

2. The marking machine of claim 1 wherein said drive means includes means for arcuately moving said first marking plate relative to said second marking plate.

3. The marking machine of claim 2 wherein said drive means includes means for pivoting said first marking plate about an axis of rotation.

4. The marking machine of claim 3 wherein said drive means further includes equalizer means for moving said first and second marking media relative to the garment with oppositely-directed angular velocity at the moment of contact with the garment.

5. The marking machine of claim 4 wherein said drive means further includes equalizer means for causing said first and second marking media to approach the garment relatively with equal but oppositely-directed angular velocity at the moment of contact with the garment.

6. The marking machine of claim 1 wherein said drive means causes said first marking plate and relatively said second marking plate to return to said ready position a predetermined period after said first marking plate approaches said marking position.

7. The marking machine of claim 6 additionally including means for varying the predetermined period.

8. The marking machine of claim 1 wherein said drive means is actuatable for a cycle of movement from said ready position to said marking position and back to said ready position by a smart switch requiring release thereof intermediate repetitions of the cycle.

9. The marking machine of claim 1 wherein said marking media ar spring-loaded on their respective marking plates.

10. The marking machine of claim 1 wherein said first and second garment marking media are separate and distinct from one another at all times.

11. A machine for marking a garment for subsequent operations, comprising:

(A) a frame;

(B) a first garment marking plate mounted on said frame and carrying a plurality of first garment marking media;

(C) a second garment marking plate mounted on said frame and carrying a plurality of second garment marking media;

(D) drive means for arcuately moving said first marking plate relative to said second marking plate between a ready position wherein said first and second marking media are spaced from each other and from the garment and a marking position wherein said first and second marking media are in close proximity to each other and in simultaneously initiate contact with the garment to mark the garment, said drive means further includes equalizer means for moving said first and second marking media relative to the garment with oppositely-directed angular velocity at the moment of contact with the garment; and (E) a platen mounted on said frame intermediate said first and second marking plates for supporting the garment and maintaining it spaced from said first and second marking media when said first and second marking plates are in said ready position.

12. The marking machine of claim 11 wherein said platen includes openings therein to permit passage of said second marking media therethrough.

13. The marking machine of claim 11 wherein said equalizer means causes said platen to move arcuately in the same arcuate direction as said first marking plate at the moment of contact with the garment.

14. The marking machine of claim 13 wherein said equalizer means causes said platen to pivot in the same arcuate direction as and at about 50% of the velocity of said first marking plate at the moment of contact.

15. The marking machine of claim 13 wherein said second marking plate is stationary.

16. The mixture machine of claim 11 wherein said equalizer means causes said platen to pivot through a fraction of the angle through which said first marking plate is pivoted during the same period.

17. The marking machine of claim 16 wherein said equalizer means causes said platen to pivot through about 50% of the angle through which said first marking plate is pivoted during the same period.

18. The marking machine of claim 16 wherein said second marking plate is stationary while said equalizer means causes said platen to pivot.

19. The marking machine to claim 11 wherein said equalizer means does not cause said platen to pivot until the initial major portion of the movement of said first marking plate.

20. The marking machine of claim 19 wherein said equalizer means initiates movement of said platen when said first marking media are about 0.015 inch from the garment.

21. The marking machine of claim 19 wherein said equalizer pivots said platen about only 1.5 degrees.

22. The marking machine of claim 19 wherein said equalizer pivots said platen no more than about 0.25 inch.

23. The marking machine of claim 11 wherein said frame is configured and dimensioned to enable end-loading of a garment onto said platen intermediate said marking plates.

24. The marking machine of claim 11 wherein said first marking plate and said platen are both pivotable about the same axis of rotation.

25. A machine for marking a garment for placement of buttons and buttonholes, comprising:

(A) a frame;

(B) a first garment marking plate movably mounted on said frame and carrying a plurality of spring-loaded first garment marking media;

(C) a second garment marking plate fixedly mounted on said frame and carrying a plurality of spring-loaded second garment marking media;

(D) drive means for arcuately moving said first marking plate relative to said second marking plate between a ready position wherein said first and second marking media are spaced from each other and from the garment and a marking position wherein said first and second marking media are in close proximity to each other and in simultaneous contact with the garment to mark the garment, said drive means further includes equalizer means for causing said first and second marking media to move relative to the garment with oppositely-directed angular velocity at the moment of contact with the garment, said drive means additionally causing said first and second marking plates to return to said ready position a variable predetermined period after said first marking plate approaches said marking position and being actuatable for a cycle of movement from said ready position to said marking position and back to said ready position by a smart switch requiring release thereof intermediate repetitions of the cycle; and (E) a platen movably mounted on said frame intermediate said first and second marking plates for supporting the garment and maintaining it spaced from said first and second marking media when said first and second marking plates are in said ready position, said platen including openings therein to permit passage of said second marking media therethrough, said equalizer means causing said platen to move arcuately in the same arcuate direction as said first marking plate at the moment of contact with the garment and through a fraction of the angle through which said first marking plate is pivoted during the same period, said frame being configured and dimensioned to enable end-loading of a garment onto said platen intermediate said marking plates.

26. The marking machine of claim 25 wherein said equalizer means does not cause said platen to pivot during the initial major portion of the movement of said first marking plate, initiates movement of said platen only when said first marking media are about 0.015 inch from the garment, and pivots said platen about only 1.5 degrees.

27. The marking machine of claim 25 wherein said first marking plate and said platen are both pivotable about the same axis of rotation.

28. A machine for marking a garment for subsequent operations, comprising:

(A) a frame;

(B) a first garment marking plate mounted on said frame and carrying a plurality of first garment marking media;

(C) a second garment marking plate mounted on said frame and carrying a plurality of second garment marking media;

(D) drive means for moving said first marking plate relative to said second marking plate between a ready position wherein said first and second marking media are spaced from each other and from the garment and a marking position wherein said first and second marking media are in close proximity to each other and in simultaneous contact with the garment to mark the garment, said drive means causing said first marking plate and relatively said second marking plate to return to said ready position a predetermined period after said first marking position; and (E) means for varying the predetermined period.

29. A machine for marking a garment for subsequent operations, comprising:

(A) a frame;

(B) a first garment marking plate mounted on said frame and carrying a plurality of second garment marking media;

(C) a second garment marking plate mounted on said frame and carrying a plurality of second garment marking media;

(D) drive means for arcuately moving said first marking plate relative to said second marking plate between a ready position wherein said first and second marking media are spaced from each other and from the garment and a marking position wherein said first and second marking media are in close proximity to each other and in simultaneous contact with the garment to mark the garment, said drive means further includes equalizer means for moving said first and second marking media relative to the garment with oppositely-directed angular velocity at the moment of contact with the garment;

(E) a platen mounted on said frame intermediate said first and second marking plates for supporting the garment and maintaining it spaced from said first and second marking media when said first and second marking plates are in said ready position;

said equalizer means causes said platen to pivot in the same arcuate direction as and at about 50% of the velocity of said first marking plate at the moment of contact.

30. A machine for marking a garment for subsequent operations, comprising:

(A) a frame;

(B) a first garment marking plate mounted on said frame and carrying a plurality of first garment marking media;

(C) a second garment marking plate mounted on said frame and carrying a plurality of second garment marking media;

(D) drive means for arcuately moving said first marking plate relative to said second marking plate between a ready position wherein said first and second marking media are spaced from each other and from the garment and a marking position wherein said first and second marking media are in close proximity to each other and in simultaneous contact with the garment to mark the garment, said drive means further includes equalize means for moving said first and second marking media relative to the garment with oppositely-directed angular velocity at the moment of contact with the garment;

(E) a platen mounted on said frame intermediate said first and second marking plates for supporting the garment and maintaining it spaced from said first and second marking media when said first and second marking plates are in said ready position;

said equalizer means causing said platen to pivot through a fraction of the angle through which said first marking plate is pivoted during the same period.

31. The marking machine of claim 30 wherein said equalizer means causes said platen to pivot through about 50% of the angle through which said first marking plate is pivoted during the same period.

32. The marking machine of claim 30 wherein said second marking plate is stationary while said equalizer means causes said platen to pivot.

33. A machine for marking a garment for subsequent operations, comprising:

(A) a frame;

(B) a first garment marking plate mounted on said frame and carrying a plurality of first garment marking media;

(C) a second garment marking plate mounted on said frame and carrying a plurality of second garment marking media;

(D) drive means for arcuately moving said first marking plate relative to said second marking plate between a ready position wherein said first and second marking media are spaced from each other and from the garment and a marking position wherein said first and second marking media are in close proximity to each other and in simultaneous contact with the garment to mark the garment, said drive means further includes equalizer means for moving said first and second marking media relative to the garment with oppositely-directed angular velocity at the moment of contact with the garment; and (E) a platen mounted on said frame intermediate said first and second marking plates for supporting the garment and maintaining it spaced from said first and second marking media when said first and second marking plates are in said ready position;

said equalizer means initiating movement of said platen when said first marking media are about 0.015 inch from the garment.

34. A machine for marking a garment for subsequent operations, comprising:

(A) a frame;

(B) a first garment marking plate mounted on said frame and carrying a plurality of first garment marking media;

(C) a second garment marking plate mounted on said frame and carrying a plurality of second garment marking media;

(D) drive means for arcuately moving said first marking plate relative to said second marking plate between a ready position wherein said first and second marking media are spaced from each other and from the garment and a marking position wherein said first and second marking media are in close proximity to each other and in simultaneous contact with the garment to mark the garment, said drive means further includes equalizer means for moving said first and second marking media relative to the garment with oppositely-directed angular velocity at the moment of contact with the garment;

(E) a platen mounted on said frame intermediate said first and second marking plates for supporting the garment and maintaining it spaced from said first and second marking media when said first and second marking plates are in said ready position;

said first marking plate and said platen both being pivotable about the same axis of rotation;

* * * * *